US005216318A

United States Patent [19]

Van Dulmen et al.

[11] Patent Number: 5,216,318

[45] Date of Patent: Jun. 1, 1993

[54] CAPPED HIGH-PRESSURE DISCHARGE LAMP AND LAMPHOLDER FOR SAME

[75] Inventors: Hendrikus A. M. Van Dulmen; Godefridus N. M. Verspaget, both of Eindhoven, Netherlands

[73] Assignee: U.S. Philips Corporation, New York, N.Y.

[21] Appl. No.: 764,664

[22] Filed: Sep. 24, 1991

[30] Foreign Application Priority Data

Sep. 28, 1990 [NL] Netherlands ..... 9002124

[51] Int. Cl.[5] ..... H01J 5/48

[52] U.S. Cl. ..... 313/49; 313/51; 313/318; 362/226; 362/262; 439/614

[58] Field of Search ..... 313/49, 51, 113, 25, 313/318; 362/226, 262; 439/611, 613, 614, 617, 618, 668, 669, 675

[56] References Cited

U.S. PATENT DOCUMENTS

| | | | |
|---|---|---|---|
| 1,321,934 | 11/1919 | Merchant | 439/675 |
| 3,422,393 | 1/1969 | Plagge | 439/613 |
| 3,676,834 | 7/1972 | Kaldor et al. | 439/350 |
| 4,001,625 | 1/1977 | Schat et al. | 313/318 |
| 4,626,734 | 12/1986 | Greiler | 313/318 |
| 4,843,266 | 6/1989 | Szanto et al. | 313/25 |
| 4,868,456 | 9/1989 | Sanders et al. | 313/51 |
| 5,036,439 | 7/1991 | Hoffmann et al. | 313/113 |

FOREIGN PATENT DOCUMENTS

| | | | |
|---|---|---|---|
| 0245080 | 4/1987 | Fed. Rep. of Germany | 313/318 |

*Primary Examiner*—Donald J. Yusko
*Assistant Examiner*—N. D. Patel
*Attorney, Agent, or Firm*—Paul R. Miller

[57] ABSTRACT

The capped high-pressure discharge lamp has a lamp cap of insulating material provided with a centrally disposed contact member and with a metal sleeve concentrical thereto. A first end of a discharge vessel is mounted within said metal sleeve and a current supply conductor is attached to said metal sleeve. The rotationally symmetrical geometry of the cap allows insertion of the lamp into a holder in any rotational position.

18 Claims, 1 Drawing Sheet

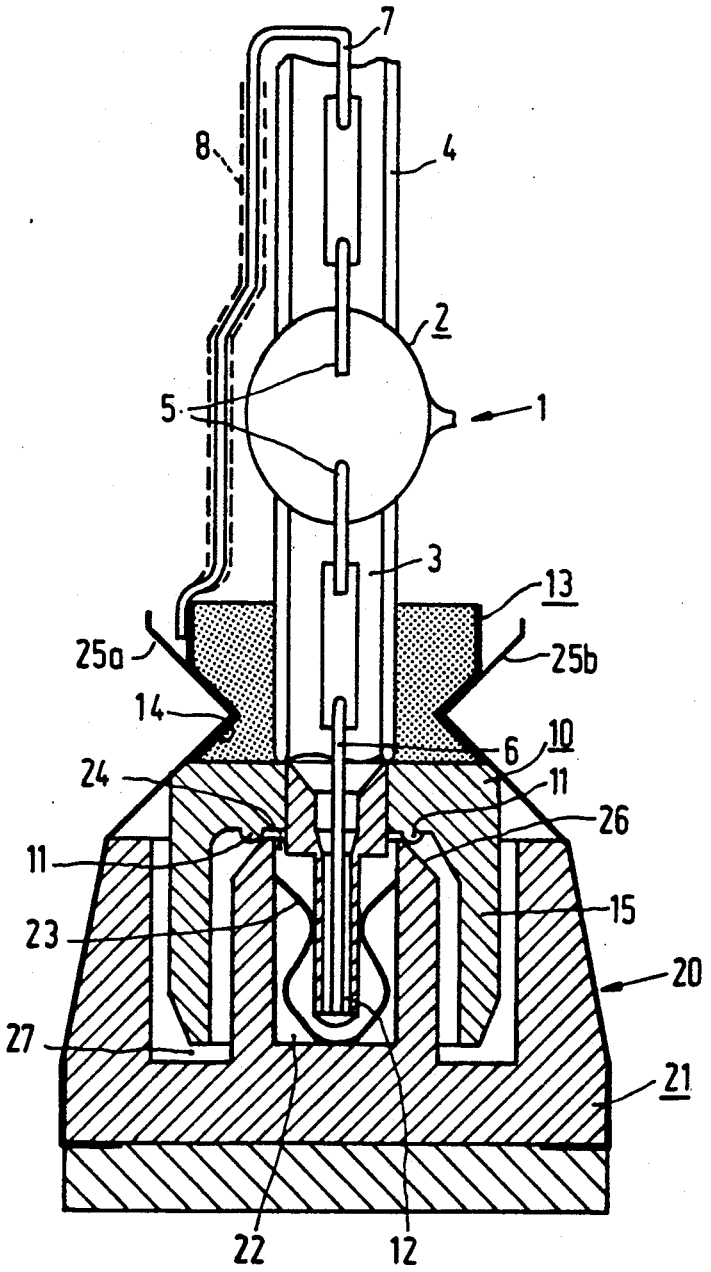
7
8
4
2
5
1
3
13
25a
25b
14
6
10
24
11
26
11
15
23
20
27
21
22
12

CAPPED HIGH-PRESSURE DISCHARGE LAMP AND LAMPHOLDER FOR SAME

BACKGROUND OF THE INVENTION

The invention relates to a capped high-pressure discharge lamp comprising a lamp vessel which is closed in a vacuumtight manner and has opposing first and second ends and an ionizable gas filling, and in which a pair of electrodes is arranged;

a first and a second current supply conductor which are connected to the pair of electrodes and which extend to the exterior from the first and the second end, respectively;

a lamp cap of insulating material mounted to the first end of the lamp vessel and provided with a first, central contact member which is connected to the first current supply conductor, and with a second contact member which is connected to the second current supply conductor.

The invention also relates to a lampholder for such a lamp.

Such a capped high-pressure discharge lamp and a lampholder suitable for it are known from EP 0 157 357 B1 which corresponds to U.S. Pat. No. 4,626,734.

Lamps of this kind are designed for use in scenic illumination when positioned inside a reflector, for example, for photo, film, or video shots. For that purpose, it is favourable if the reflector surrounds the lamp through a large solid angle, because in that case a large fraction of the generated light is concentrated into a beam.

The lamp cap of the known lamp has a laterally extending slot in which the second current supply conductor and the second contact member are eccentrically fixed with cement, laterally situated relative to the first contact member. The lamp cap as a result has a comparatively great lateral dimension and the reflector of the luminaire in which the lamp is to be used must have a comparatively great opening so that the lamp cap can be inserted through it into the lampholder arranged outside the reflector. This causes a loss in the beam concentration power of the reflector. Moreover, insertion of the lamp into the lampholder is difficult because the lamp cap must be accurately aimed during this in order to bring the second contact member into contact with the corresponding terminal of the lampholder.

SUMMARY OF THE INVENTION

The invention has for its object to provide a lamp of the kind described in the opening paragraph which inter alia can be easily inserted into a holder. The invention also envisages a lamp having a lamp cap which can be of compact design. Furthermore, the invention envisages a lampholder for such a lamp.

The envisaged lamp is realised in that the lamp cap has a substantially rotationally symmetrical metal sleeve around the first end of the lamp vessel, which sleeve is substantially concentric with the first contact member, within which sleeve the first end is fixed, and to which sleeve the second current supply conductor is fastened.

The metal sleeve forms the second contact of the lamp cap. Owing to the rotationally symmetrical configuration of the contacts of the lamp cap, the lamp cap may be inserted into the lampholder in any rotational position. It is also possible, as a result, to give the lamp cap a compact design.

In a favourable embodiment, the metal sleeve has a circumferential relief, for example a circular elevation or circular groove, with which a corresponding clamp of a lampholder can cooperate. The clamp may either serve exclusively for retaining the lamp or also for achieving an electrical connection to a supply source.

The lamp cap may have elevations around the first central contact member on a circle which is concentric with this contact member. These elevations may cooperate with the lampholder in which the lamp is inserted in order to form a depth stop. This is important for positioning the lamp with its electrodes in a spot inside a reflector previously determined by the luminaire manufacturer.

To reduce the breakdown risk, it is useful if the central contact member is surrounded by a circular rim of the lamp cap.

The second current supply conductor may be connected to the neutral lead of the supply terminal of the lamp for handling safety. In addition, this current supply lead may be surrounded at least substantially by an insulator. This is also useful if the ionizable filling of the lamp contains sodium, with the object of preventing the disappearance thereof as a result of photoemission. It is favourable if the insulator is an insulating coating of the second current supply conductor. Such a coating, for example of $Si_3N_4$ and/or $SiO_2$, possibly on a bonding layer of $Al_2O_3$, renders it possible to insulate a kinked or curved current supply conductor also on kinks or curves.

The lampholder according to the invention designed for use with the capped high-pressure discharge lamp according to the invention is provided with a body of insulating material comprising a first cavity with a first clamping contact and an insertion opening in order to give a first, central contact member of the lamp access to the clamping contact;

a second clamping contact outside the first cavity for making contact with a second contact member of the lamp; the second clamping contact being substantially concentric with the first and comprising several contact elements which project from the body of insulating material.

In an embodiment, the body of insulating material, for example of ceramic material, such as steatite or mica-filled glass, has a circular second cavity around the first cavity so as to accommodate a circular rim of the lamp cap.

It is favourable if the body of insulating material of the lampholder has a tapering surface for cooperating with elevations of the lamp cap. Such a surface in conjunction with these elevations then not only forms a depth stop for the lamp, but also has a centering function. In an embodiment, the tapering surface is convex. It then has a locating function during insertion of the lamp cap into the lampholder, which facilitates the centering action.

BRIEF DESCRIPTION OF THE DRAWING

An embodiment of the capped high-pressure discharge lamp and of the lampholder according to the invention is shown in the drawing, the discharge vessel in side elevation, the lamp cap and the lampholder in which the lamp is placed in longitudinal section.

DESCRIPTION OF THE PREFERRED EMBODIMENT

In the drawing, the capped high-pressure discharge lamp 1 has a lamp, or discharge, vessel 2 which is closed in a vacuumtight manner and is made of, for example, quartz glass comprising first and second, opposing ends 3 and 4, respectively, and an ionizable gas filling, for example consisting of a rare gas, mercury, and metal halides. A pair of electrodes 5 is arranged in the lamp vessel.

First and second current supply conductors 6 and 7, respectively, connected to the pair of electrodes extend from the first and second ends 3 and 4, respectively, of the lamp vessel to the exterior.

A lamp cap 10 of insulating material is fastened to the first end 3 of the lamp vessel and provided with a first, central contact member 12 which is connected to the first current supply conductor 6, and with a second contact member 13 which is connected to the second current supply conductor 7.

The lamp cap 10 has a substantially rotationally symmetrical metal sleeve 13 around the first end 3 of the lamp vessel, which sleeve is substantially concentric with the first contact member 12 and within which sleeve the first end 3 of the discharge vessel is fixed. The second current supply conductor 7 is fastened to this sleeve which functions as the second contact member.

The metal sleeve 13 has a continuous circular relief in the form of a circumferential groove 14 with which retention means of a lampholder can engage, or a clamping terminal of the lampholder for making electrical contact. Alternatively, a terminal of the lampholder may make contact elsewhere separately from retention means.

The central contact member 12 is surrounded by a circular rim 15 of the lamp cap 10.

The lamp cap 10 has elevations 11, which serve as a depth stop for the lamp cap, on a circle which is substantially concentric with the central contact member 12.

The second current supply conductor 7 is surrounded at least substantially by an insulator, in the drawing it is covered with a coating 8 of $SiO_2$.

The lampholder 20 designed for use with the capped high-pressure discharge lamp 1 according to the invention is provided with a body 21 of insulating material, which has a first cavity 22 with a first clamping contact 23 and an insertion opening 24 to give a first contact member 12 of the lamp access to the clamping contact. The lampholder 20 has a second clamping contact 25 outside the first cavity 22 in order to make contact with a second contact member of the lamp.

The second contact clamp 25 is substantially concentric with the first 23 and comprises several contact elements, two of which **25*a* and 25*b* are shown in the drawing. These contact elements project from the body 21** of insulating material.

The lampholder 20 has a circular second cavity 27 around the first 21 in order to accommodate the circular rim 15 of the lamp cap 10.

The body 21 of insulating material has a tapering surface, in the drawing a convex tapering surface 26. It has a locating function during insertion of the lamp cap 10, forms a depth stop together with the elevations 11, and centers the lamp cap 10.

We claim:

1. A luminaire, comprising:

a) a high pressure discharge lamp comprising a discharge vessel energizeable for emitting light and having first and second sealed end portions, first and second current-supply conductors extending through respective sealed end portions to the exterior thereof, and a lamp cap comprising an insulative body holding said first sealed end portion, said lamp cap having a first centrally disposed elongated lamp contact aligned with said discharge vessel and connected to said first current-supply conductor, and a second lamp contact comprised of a rotationally symmetric metal sleeve secured on said body and disposed around said first sealed end portion and substantially concentric with said first contact, said second current-supply conductor being connected to said metal sleeve, and said metal sleeve comprising one of a circumferentially extending groove and elevation; and b) a lampholder comprising a body of insulative material having a first cavity, a first resilient clamping contact disposed within said first cavity, said first cavity having an insertion opening through which said first centrally disposed lamp contact of said lamp cap is insertable into said first cavity for engaging and being clamped by said first clamping contact, and a second resilient clamping contact arranged radially outside of said first cavity, said second clamping contact comprising a plurality of resilient contact elements projecting from said body of insulative material in the axial direction past said insertion opening substantially concentric with said first clamping contact, said contact elements resiliently contacting said sleeve when said lamp cap is mated with said lamp holder in any rotational orientation, at least one of said contact elements engaging in said one of said groove and elevation of said sleeve for securing said lamp in said lampholder.

2. A lampholder as claimed in claim 1, characterized in that said body of insulative material has a tapering surface at said insertion opening.

3. A luminaire according to claim 1, wherein said circumferential sleeve of said lamp base has a "V"-shaped circumferential groove set in a complementary "V"-shaped groove of said insulative lamp base body, and said contact elements each comprise a complementary "V"-shaped portion for engaging in said "V"-shaped groove of said circumferential sleeve.

4. A luminaire according to claim 1, characterized in that said lamp cap has a circular-tubular rim of insulative material which surrounds said central lamp contact.

5. A luminaire according to claim 4, wherein said circumferential sleeve of said lamp base has a "V"-shaped circumferential groove set in a complementary "V"-shaped groove of said insulative lamp base body, and said contact elements each comprise a complementary "V"-shaped portion for engaging in said "V"-shaped groove of said circumferential sleeve.

6. A luminaire according to claim 4, characterized in that said body of insulative material of said lampholder has a circular annular cavity disposed around said first cavity for receiving said circular-tubular rim of said lamp cap.

7. A luminaire according to claim 6, characterized in that said lamp cap has elevations inside said rim, on a circle which is substantially concentric with said central lamp contact, said elevations contacting said lampholder about the periphery of said insertion opening of said first cavity for axially positioning said discharge vessel a predetermined distance from said lampholder.

8. A luminaire according to claim 7, wherein said insulative body of said lampholder comprises a circular-tubular rim extending axially between said first, central cavity and said annular cavity, said rim having a circumferentially extending tapered surface engaging with said elevations on said lamp cap for centering said lamp cap with respect to said central cavity.

9. A luminaire according to claim 8, wherein said circumferential sleeve of said lamp base has a "V"-shaped circumferential groove set in a complementary "V"-shaped groove of said insulative lamp base body, and said contact elements each comprise a complementary "V"-shaped portion for engaging in said "V"-shaped groove of said circumferential sleeve.

10. A capped high-pressure discharge lamp as claimed in claim 8, characterized in that the second current supply conductor is surrounded at least substantially by an insulator.

11. A capped high pressure discharge lamp, comprising:

a) a discharge vessel energizeable for emitting light, said discharge vessel defining a lamp axis, having first and second opposing sealed end portions, and first and second current-supply conductors each extending from a respective sealed end portion; and b) a lamp cap comprising a body of insulative material having a portion circumferentially surrounding and holding said first sealed end portion of said discharge vessel, a central lamp contact aligned with and extending away from said discharge vessel and connected to said first current-supply conductor, and a second lamp contact comprised of a substantially rotationally symmetric sleeve secured on said body of insulative material and connected to said second current-supply conductor, said sleeve extending circumferentially around said first sealed end portion of said discharge vessel and having one of a circumferentially extending elevation and groove, wherein said circumferential sleeve has a "V"-shaped circumferential groove set in a complementary "V"-shaped groove of said body of insulative material.

12. A capped high-pressure discharge lamp as claimed in claim 11, characterized in that said insulative body of said lamp cap has a circular tubular rim extending axially away from said discharge vessel and surrounding said central lamp contact.

13. A capped high-pressure discharge lamp as claimed in claim 12, characterized in that said lamp cap has elevations within said rim on a circle which is substantially concentric with said central lamp contact.

14. A capped high-pressure discharge lamp as claimed in claim 13, characterized in that said second current supply conductor is surrounded at least substantially by an insulator.

15. A capped high-pressure discharge lamp as claimed in claim 1, characterized in that said lamp cap has elevations on a circle which is substantially concentric with said central lamp contact.

16. A lamp holder for a high pressure discharge lamp having a lamp cap with a first central lamp contact surrounded by a tubular rim of said cap and a second lamp contact circumferentially disposed on the periphery of said cap, said lamp holder comprising:

a body of insulative material having a central cavity with an insertion opening for receiving said central lamp contact and an annular cavity circumferentially surrounding said central cavity for receiving the tubular rim of the lamp cap, a tubular wall of said insulative body extending between said central and annular cavities;

a first lamp holder contact arranged in said central cavity for contacting said central lamp contact of a lamp received in said holder; and a second lamp holder contact arranged on said insulative body radially outside of said central and annular cavities and substantially concentric with said first contact, said second contact having a plurality of resilient contact elements which project from said body of insulative material in the axial direction past said insertion opening and radially inward for resiliently contacting said second circumferential lamp contact of a lamp received therein.

17. A luminaire according to claim 16, wherein said contact elements each comprise a "V"-shaped portion for engaging in a complementary "V"-shaped circumferential groove of a lamp cap contact.

18. A lampholder as claimed in claim 16, characterized in that said body of insulative material has a circumferential tapered surface at an end portion of said tubular wall for engaging with raised elevations of a lamp cap received therein for centering said lamp cap with respect to said central cavity.

* * * * *